US009033045B2

(12) United States Patent
Fincher

(10) Patent No.: US 9,033,045 B2
(45) Date of Patent: May 19, 2015

(54) APPARATUS AND METHOD FOR FRACTURING PORTIONS OF AN EARTH FORMATION

(75) Inventor: Roger W. Fincher, Conroe, TX (US)

(73) Assignee: Baker Hughes Incorporated, Houston, TX (US)

( * ) Notice: Subject to any disclaimer, the term of this patent is extended or adjusted under 35 U.S.C. 154(b) by 488 days.

(21) Appl. No.: 12/887,235

(22) Filed: Sep. 21, 2010

(65) Prior Publication Data

US 2012/0067582 A1 Mar. 22, 2012

(51) Int. Cl.

| | |
|---|---|
| ***E21B 43/26*** | (2006.01) |
| ***E21B 43/117*** | (2006.01) |
| ***E21B 43/263*** | (2006.01) |
| ***E21B 43/11*** | (2006.01) |

(52) U.S. Cl.

CPC ..... *E21B 43/263* (2013.01); *E21B 43/11* (2013.01)

(58) Field of Classification Search

CPC .... E21B 43/26; E21B 43/117; E21B 43/1185
USPC ..... 166/271, 281, 308.1–308.6, 177.5; 175/2–4.6

See application file for complete search history.

(56) References Cited

U.S. PATENT DOCUMENTS

| | | | | |
|---|---|---|---|---|
| 5,131,472 | A * | 7/1992 | Dees et al. | 166/308.1 |
| 3,011,551 | A | 9/1996 | Young | |
| 5,551,344 | A | 9/1996 | Couet et al. | |
| 5,706,895 | A * | 1/1998 | Sydansk | 166/294 |
| 5,765,642 | A | 6/1998 | Surjaatmadja | |
| 6,055,213 | A * | 4/2000 | Rubbo et al. | 367/82 |
| 6,962,203 | B2 * | 11/2005 | Funchess | 166/297 |
| 2002/0053434 | A1 * | 5/2002 | Chen et al. | 166/297 |
| 2003/0062160 | A1 * | 4/2003 | Boney et al. | 166/278 |
| 2003/0075326 | A1 * | 4/2003 | Ebinger | 166/297 |
| 2004/0188093 | A1 * | 9/2004 | Funchess | 166/299 |
| 2006/0027123 | A1 * | 2/2006 | Van Dyk et al. | 102/323 |
| 2009/0071651 | A1 * | 3/2009 | Patel | 166/297 |
| 2010/0000727 | A1 | 1/2010 | Webb et al. | |
| 2010/0292108 | A1 * | 11/2010 | Kakadjian et al. | 507/117 |

OTHER PUBLICATIONS

Travis Cavender et all, "Interfacing Fracturing and Sand Control Completion Strategies into Multilateral Technology; Considerations and Solutions"; Society of Petroleum Engineers, SPE Paper No. 80477; Apr. 15, 2003.

T.P. Lhomme et al., "Experimental Study of Hydraulic Fracture Initiation in Colton Sandstone"; Society of Petroleum Engineers, SPE Paper No. SPE/ISRM 78187, Oct. 20, 2002.

Delano Lougheide et al., "Horizontal Gravel Packs Successfully Deployed in Trinidad's First Multilateral Well-Planning, Implementation, and Remedial Strategies"; Society of Petroleum Engineers, SPE Paper No. 90220, Sep. 26, 2004.

* cited by examiner

*Primary Examiner* — Shane Bomar
*Assistant Examiner* — Kipp Wallace
(74) *Attorney, Agent, or Firm* — Cantor Colburn LLP

(57) ABSTRACT

A method of fracturing an earth formation is disclosed. The method includes: isolating a section of a borehole in the earth formation; introducing a fluid into the isolated section and pressurizing the isolated section from a first pressure to a second pressure; introducing a stress concentration to a borehole wall at least one location in the isolated section when the fluid is at the selected pressure or during the pressurization; and initiating a hydraulic fracture in the earth formation at the at least one location.

18 Claims, 2 Drawing Sheets

APPARATUS AND METHOD FOR FRACTURING PORTIONS OF AN EARTH FORMATION

BACKGROUND

In the drilling and completion industry it is known that operations affecting an earth formation including operations such as fracturing, or "fracing", operations can be beneficial for a number of reasons. In some cases, for example, fracturing operations help to stimulate the production of hydrocarbons from earth formations. In such operations, portions of the formation are fractured to increase fluid flow from the formation into a borehole. Fracturing generally includes isolating a portion of the borehole and pressurizing fluid therein to a pressure sufficient to cause a fracture in the formation. Boreholes may include both vertical and horizontal sections, such as long horizontal wells commonly used in shale gas and other tight formations. In recent years many methods have been used to allow multiple fractures to be induced along the length of a lateral section.

Fracturing techniques and systems allow borehole sections to be isolated and fractured at discrete intervals. However, fractures generally cannot be initiated at defined points, but rather the fractures most likely run from unknown points within the desired interval. These points are likely to be points of weakness or superimposed stress, such as stress caused by isolation packers. If an isolation packer causes a high stress point or a fracture from an adjacent interval has weakened the formation near the isolation packer, the new fracture may initiate in close proximity to an adjacent fracture zone. This can cause adjacent fractures to interconnect or run parallel closely together, likely resulting in a lower productivity index, resulting in much of the interval between the packers being left unfractured and less productive than planned.

SUMMARY

A method of fracturing an earth formation includes: isolating a section of a borehole in the earth formation; introducing a fluid into the isolated section and pressurizing the isolated section from a first pressure to a second pressure; introducing a stress concentration to a borehole wall at least one location in the isolated section when the fluid is at the second pressure or during the pressurization; and initiating a hydraulic fracture in the earth formation at the at least one location.

An apparatus for fracturing in an earth formation includes: an isolation assembly configured to isolate a section of a borehole in the earth formation; a fracturing assembly configured to be disposed at the isolated section, the fracturing assembly in fluid communication with a fluid source and including at least one passage to introduce fluid into the isolated section, the fracturing assembly configured to introduce a fluid into the isolated section and pressurize the isolated section from a first pressure to at least a fracture pressure to initiate a hydraulic fracture in the earth formation; and at least one perforation device disposable at a selected location within the isolated section and configured to introduce a stress concentration to a borehole wall at least one location in the isolated section when the fluid is at the selected pressure or during the pressurization.

BRIEF DESCRIPTION OF THE DRAWINGS

The following descriptions should not be considered limiting in any way. With reference to the accompanying drawings, like elements are numbered alike.

DETAILED DESCRIPTION

The apparatuses, systems and methods described herein provide for fracturing an earth formation at a controlled location and/or direction. The method includes generating a controlled formation stress concentration or stress riser coupled with initiating a hydraulic fracture in the formation. The stress riser can be controlled at both location and time relative to the hydraulic fracturing to initiate formation of the fracture at a selected location of a borehole wall and in a desired direction. In one embodiment, the system includes one or more perforation devices such as shaped charges that are configured to be fired or otherwise actuated to create a perforation in the borehole wall at the same time that a hydraulic pressure has been increased or is being increased to an elevated pressure relative to the borehole pressure. Examples of the elevated pressure include a fracture pressure, a leak-off pressure and other desired hydraulic pressures related to the fracture pressure. The systems and methods generate a stress riser or stress concentration at one or more selected locations that cause a fracture to initiate at the selected locations when a fracture process is performed.

Figure 1:
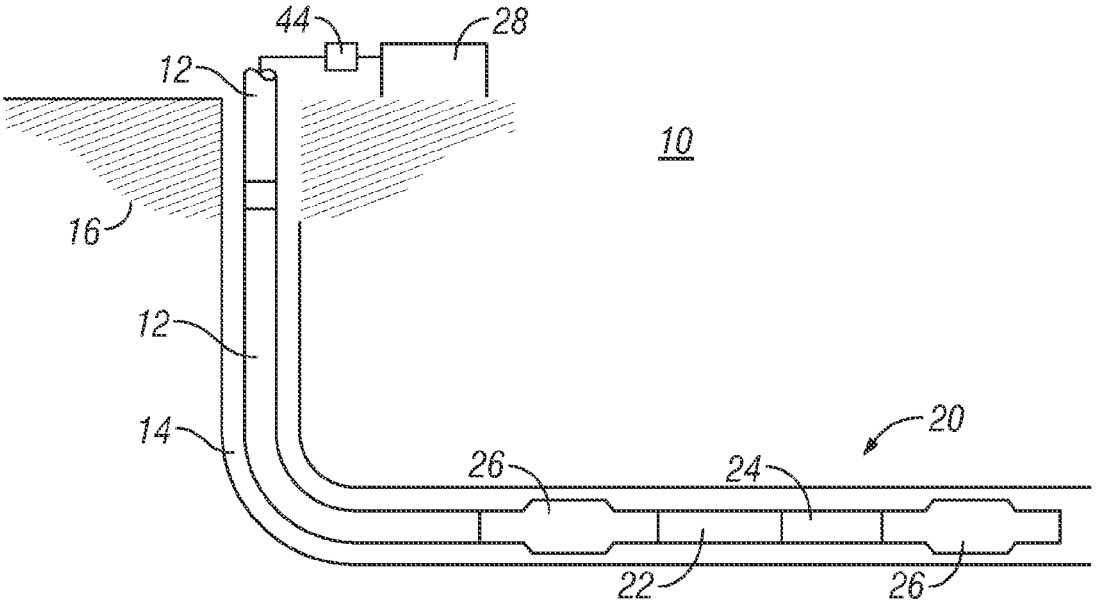
FIG. 1 is a cross-sectional view of an embodiment of a subterranean well production system.

Referring to FIG. 1, an exemplary embodiment of a subterranean formation stimulation and production system 10 includes a borehole string 12 such as a production string that is shown disposed in a borehole 14 that penetrates at least one earth formation 16 during a subterranean operation. As described herein, "formations" refer to the various features and materials that may be encountered in a subsurface environment and surround the borehole. The borehole 14 may be an open hole or a cased borehole. The borehole string 12 includes a downhole tool 20 configured to be lowered into the borehole 12 and stimulate selected portions of the earth formation 16. The tool 20 may be included with any suitable carrier, such as the borehole string 12, one or more pipe sections, one or more downhole subs, and a bottomhole assembly (BHA). A "carrier" as described herein means any device, device component, combination of devices, media and/or member that may be used to convey, house, support or otherwise facilitate the use of another device, device component, combination of devices, media and/or member. Exemplary non-limiting carriers include drill strings of the coiled tube type, of the jointed pipe type and any combination or portion thereof. Other carrier examples include casing pipes, wirelines, wireline sondes, slickline sondes, drop shots, downhole subs, bottomhole assemblies, and drill strings.

The tool 20 includes a hydraulic fracturing assembly 22, such as a fracture or "frac" sleeve device, and a perforation assembly 24. The perforation assembly 24 may be any device or tool configured to generate a stress concentration or otherwise create a weak point or weak region at a localized portion of the borehole wall. Examples of the perforation assembly 24 include shaped charges, torches, projectiles and other devices for perforating the borehole wall and/or casing.

In one embodiment, the system 10 includes one or more isolation assemblies 26 configured to isolate a portion of the borehole 12. As referred to herein, an "isolated portion" or "isolated section" refers to a portion or section of the borehole 12 that is at least substantially isolated with respect to fluid pressure from the rest of the borehole 12. In one embodiment, the isolation assembly 26 is a packer sub or other component that includes one or more packers. A "fluid" refers to any flowable substance such as water, oil or other liquids, air, and flowable solids such as sand.

One or more of the tool 20, the fracturing assembly 22, the perforation assembly 24 and/or isolation assembly 26 may include suitable electronics or processors configured to communicate with a surface processing unit 28 and/or control the respective tool or assembly.

Figure 2:
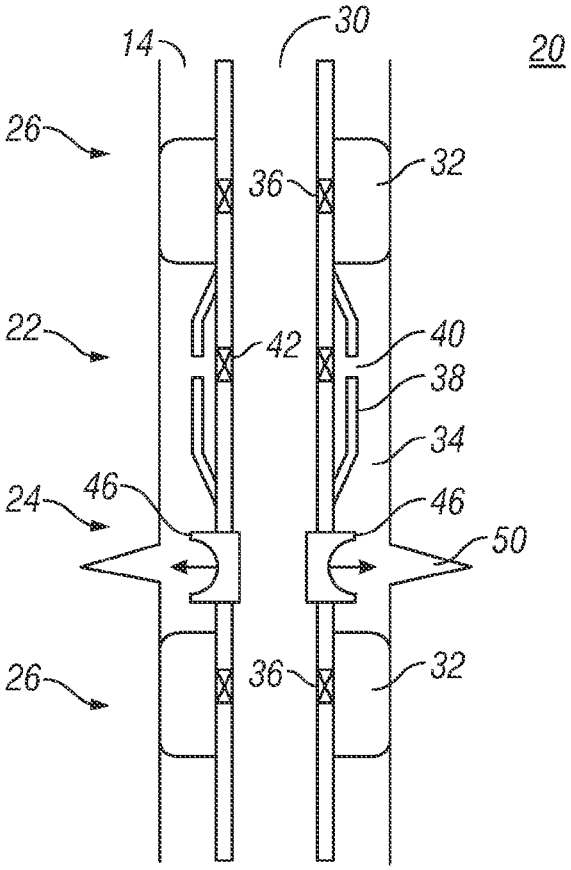
FIG. 2 is an axial cross-sectional side view of a downhole formation fracturing tool.

FIG. 2 illustrates an embodiment of the tool 20 for stimulating a portion of the formation 16. In one embodiment, the tool 20 is moveable along a length of the borehole 14 to allow for fracturing the formation 16 at multiple depths and locations along the borehole 14. Although only a single tool 20 is shown in FIG. 2, multiple tools 20 may be disposed along the borehole string 12 or other carrier to affect fracturing at multiple locations along the borehole 14.

In the embodiment of FIG. 2, the borehole string 12 includes a fluid conduit 30 in fluid communication with a surface fluid source for introducing production fluid into the borehole 12 to facilitate production and/or regulate fluid pressure in the borehole string 12 and the borehole 14. In one embodiment, the isolation assembly 26 includes one or more packers 32 that can be actuated to isolate a section of the borehole 14, referred to as an isolated section 34. The packers 32 may be actuated by any suitable mechanism, such as an inflatable packer, an expandable material, a swellable material and a spring-type or mechanical assembly. For example, the packers 32 are inflatable packers in fluid communication with the fluid conduit via one or more packer valves 36 such as ball seat valves. In one embodiment, the packer valves 36 are actuatable to divert fluid from the fluid conduit 30 into the packers 32 to inflate the packers 32 and cause them to isolate the section 34. Each packer 32 provides a pressure barrier within the borehole 14 and separates downhole fluid above and/or below the packer 32 from fluid in the isolated section 34.

The fracturing assembly 22, in one embodiment, includes a fracing sleeve or other housing 38 that includes including one or more passages or holes 40 and a valve assembly 42 such as a ball seat valve that is actuated to allow fracing fluid or other downhole fluid to be pumped or otherwise introduced into the isolated section 34. The fracing fluid may be any type of fluid, such as water, brine, hydrocarbon fluid, alcohol, guar based fracturing fluids, cellulosic polymeric compounds, gels, wellbore fluid and others.

In one embodiment, the system 10 includes a pumping mechanism such as one or more pumping units 44. The pumping units 44 are disposed in fluid communication with the fluid conduit 30 at a downhole and/or surface location. In one embodiment, the pumping unit 44 includes an electric motor or pump motor at the surface or downhole. The pumping unit 44 can be used to pressurize fluid in the isolated section 34 to initiate a fracture. In addition, the pumping unit 44 can be used to inflate the packers 32 via, for example, the packer valve(s) 36.

The perforation assembly 24 includes a housing such as a perforating sub, or may include one or more perforation devices 46 disposed on the frac sleeve 38 or other downhole component and configured to be located at the isolated section 34. In the embodiment shown in FIG. 2, the one or more perforation devices 46 include one or more shaped charges that are configured to be directed toward the borehole wall and located at selected angular or circumferential locations on the borehole string 12 relative to a longitudinal axis of the borehole 14, so that the shaped charges are oriented along one or more desired directions. The perforating devices 46 are positioned at a selected depth and/or the borehole string 12 can be moved axially and/or rotated so that the perforating devices can be positioned and directed as desired to control the location and direction of the fracture. The fracturing assembly 22 and the perforation assembly 24 may be incorporated into individual assemblies or subs, as shown in FIG. 1, or may be incorporated into a single downhole sub, frac sleeve, pipe section or other housing. For example, before or during the building and lowering of the borehole string 12 downhole, one or more directional perforation charges or other perforation devices 46 are installed on the borehole string 12 at a desired fracture initiation point. This set of perforation devices 46 could be placed and oriented so as to create a point of fracture initiation whose length location along the borehole 14 is known and whose orientation relative to the borehole high-side is known and can be controlled.

Figure 3:
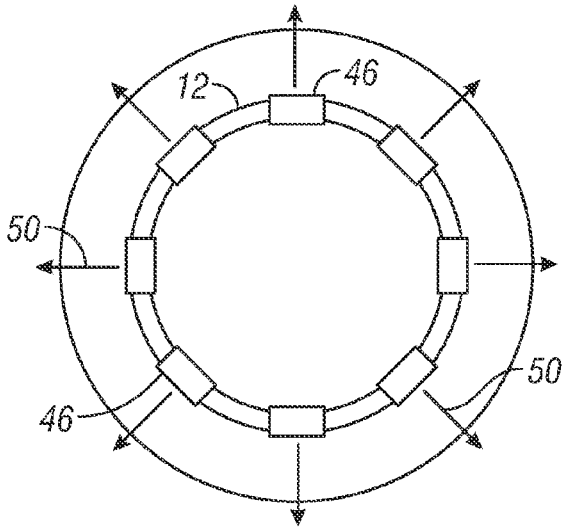
FIG. 3 is a radial cross-sectional view of the tool of FIG. 2.

Referring to FIG. 3, in one embodiment, the perforation assembly 24 includes a plurality of perforation charges or other perforation devices 46 distributed circumferentially (e.g., in a ring) around the borehole string 12 or other component so that the formation is perforated in a ring. The perforation devices 46 are arranged circumferentially in the borehole 14 and directed substantially radially so that all of the perforations 50 are directed radially and in substantially the same plane to affect a planar stress concentration or "knife cut". This configuration may aid in ensuring that the fracture will initiate and propagate substantially along a plane formed by the arranged perforation devices 46.

Figure 4:
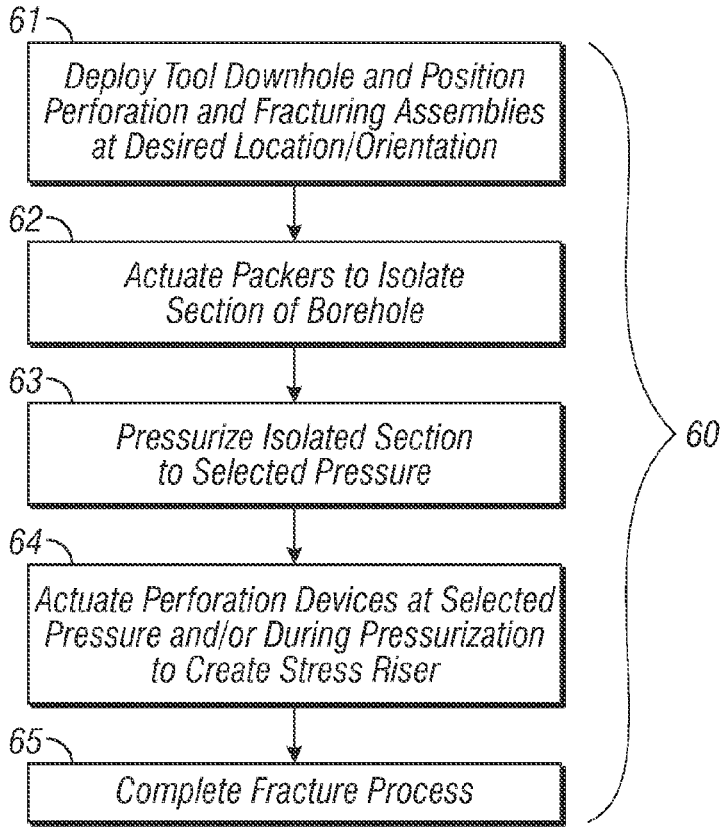
FIG. 4 is a flow diagram depicting a method of fracturing an earth formation.

FIG. 4 illustrates a method 60 of fracturing an earth formation. The method 60 includes one or more stages 61-65. The method may be performed repeatedly and/or periodically as desired, and may be performed for multiple depths in a selected length of the borehole 12. The method 60 is described herein in conjunction with the downhole tool 20, although the method may be performed in conjunction with any number and configuration of processors, sensors and tools. The method 60 may be performed by one or more processors or other devices capable of receiving and processing measurement data, such as the surface processing unit 28 or downhole electronics units. In one embodiment, the method 60 includes the execution of all of stages 61-65 in the order described. However, certain stages 61-65 may be omitted, stages may be added, or the order of the stages changed.

In the first stage 61, the tool 20 is deployed downhole and advanced along the borehole 14 to a desired position, such as via a production string 12 or a wireline. The desired position is a depth or point along the borehole 14 at which a fracture is desired to be initiated. The desired point could be selected, for example, from previous formation evaluation measurements, such as logs, mineralogy studies and/or models generated from logging-while-drilling (LWD) or wireline measurements so that the stress risers and packers are placed at optimum locations.

In the second stage 62, when the fracturing assembly 22 and the perforation devices 46 are located at a desired position, the packers 32 (or other isolation assembly 26) are actuated to isolate a section 34 of the borehole 14. For example, packer valves 36 are opened and downhole fluid is diverted from the fluid conduit 30 to inflate the packers 32.

In the third stage 63, fluid is introduced into the isolated section 34 via, for example, the pumping unit 44, and the isolated section 34 is pressurized to a desired pressure. The desired pressure may be a fracture pressure, a pressure above the fracture pressure, or any other pressures related to the fracture pressure. A fracture pressure is a pressure that is at least sufficient to cause a crack or fracture to form in the formation 16. In one embodiment, the fracture pressure is at least approximately known from past fracturing experience and/or through geomechanical modeling. In some embodiments, the isolated section 34 is pressurized to one or more intermediate pressures prior to pressurizing the isolated section 34 to the fracture pressure. For example, the fluid pressure in the isolated section 34 can be raised to a mini-frac or leak-off pressure and held substantially constant.

The "mini-frac" pressure is a pressure typically used during a mini-frac treatment, which is a small fracturing treatment performed before the main hydraulic fracturing treatment to acquire job design and execution data and confirm the predicted response of the treatment interval. Mini-frac procedures can be used to provide design data from the parameters associated with the injection of fluids and the subsequent pressure decline.

The "leak-off" pressure is a pressure exerted on a formation that is sufficient to cause fluid to be forced into the formation, and is generally lower than the fracture pressure. The leak-off pressure is often associated with a leak-off test, which is a test to determine the strength or fracture pressure of a formation. During the test, the well is shut in and fluid is pumped into the borehole to gradually increase the pressure that the formation experiences. At some pressure (the leak-off pressure), fluid will enter the formation, or leak off, either moving through permeable paths in the rock or by creating a space by fracturing the rock. Results of a leak-off test can be used to determine the maximum pressure or mud weight that may be applied to the well during drilling operations.

In the fourth stage 64, when the pressure in the isolated section 34 is at the desired pressure (e.g., at or above the fracture pressure), or during pressurization of the isolated section 34 (e.g., when the pressure is increasing at a desired rate), the perforation devices 46 are actuated to perforate the borehole wall at the desired location and direction. In one example, the perforation devices 46 are directed charges that are actuated, for example, via a detonation cord. The perforation devices 46 may be manually actuated by a user at the surface or automatically actuated via suitable electronics based on pressure measurements taken in the isolated section 34, fluid flow rates and/or pumping rates. In one embodiment, multiple perforation devices 46 are positioned circumferentially and radially oriented to produce the "knife cut" which produces a hoop stress that is based upon a ratio of the borehole diameter to the knife cut diameter. The perforation devices 46 may be configured to control the hoop stress on the borehole wall by varying the radial position of the devices 46 in the borehole and/or the strength of the perforation devices 46.

The combination of the increased pressure and perforation creates a stress riser at the desired location and in the desired direction which creates an initiation point from which the fracture can initiate and can also help control the direction along which the fracture may propagate. When the pressure within the stress riser region exceeds the fracturing pressure, fractures are created adjacent the borehole 14 that extend into the earth formation 16 and enhance hydrocarbon production from the formation 16 into the borehole 14. By creating the pressure riser, the fracture is initiated at or near the location or locations that the perforation was formed due to the combination of fluid pressure and the perforation.

In one embodiment, the isolated section pressure is rapidly increased to a desired pressure, such as the fracture pressure or a pressure higher than the fracture pressure, and the perforation devices 46 are actuated at or near the point in time at which the desired pressure is reached. In one embodiment, the isolated section pressure is increased to the desired pressure, held substantially constant, and the perforation devices 46 are actuated at the desired pressure.

In one embodiment, the timing of the stress riser creation and the fracture initiation are synchronized by synchronizing pressurization and perforation. For example, the perforation devices 46 are actuated at least substantially concurrently with the fluid pressure reaching the fracture pressure or other desired pressure in the isolated section 34. In other embodiments, a phased delay is utilized between pressurization and perforation, so that a selected period of time elapses between realization of the fracture pressure (or other desired pressure) and actuation of the perforation devices 46 to perforate the borehole wall. In phased embodiments, the perforation devices 46 may be actuated prior to or after achieving the desired pressurization.

In the fifth stage 65, the normal fracturing process is followed to complete the fracturing operation at the selected location. For example, fluid continues to be pumped into the fracture at desired pressures to extend the fracture. In one embodiment, a proppant such as sand is subsequently pumped into the fracture to keep the fracture open and allow formation hydrocarbons to flow into the borehole 14.

The method 60 may be repeated for each location (e.g., each lateral section) having a pre-placed perforation device 46, or the tool 20 may be moved to one or more additional depths or locations along the borehole 14 and the method 60 repeated for each depth or location.

Additional examples of the method 60 are described herein. In a first example, the pressure in the isolated section 34 is increased to the leak-off point, the pressure is then optionally held until perforation devices 46 and/or pumping units 44 are ready, and pumping is rapidly increased to fracture rates. The perforation devices 46 are manually actuated, such as via an electric trigger, to actuate the perforation devices 46 while the pressure is being increased from the leak-off point or upon reaching at least the fracture pressure.

In another example, the pressure in the isolated section 34 is increased to the leak-off point, the pressure is then optionally held until perforation devices 46 and/or pumping units are ready, and pumping is rapidly increased to fracture rates and the perforation devices 46 are automatically initiated from within a self-contained and powered perforation module 24 for the selected location. The module 24 can be programmed so that perforation is initiated based on a signal from the pumping unit 44 and/or based on flow rate, pressure or rates of pressure change measured by the module 24 or communicated to the module from a remote location. In a further example, once the leak off pressure is reached, a high and short pressure hold acts as a pre-trigger to the module 24, followed by a rapid time based rise in pressure that acts as a trigger point that causes the module 24 to fire or otherwise actuate the perforation devices 46.

The systems and methods described herein provide various advantages over existing processing methods and devices. For example, the systems and methods allow formation fractures to be initiated at precisely controlled locations and/or directions. Causing the fracture to initiate at a particular point potentially gives a better production return than allowing the fracture to self-initiate, since the fracture can be accurately initiated at identified pay zones and identified production zones within a formation are more accurately fractured to yield greater production.

The systems and methods are able to cause the fracture to initiate at a defined point, and are thereby able to avoid allowing the fracture to initiate from other points of weakness or superimposed stress such as an isolation packer. If the isolation packer causes a high stress point or the fracture from the adjacent interval weakened the formation near the isolation packer, it is likely that the new fracture my initiate in close proximity to the previous or run toward and connect with the previous fracture. Where these adjacent fractures to interconnect or run parallel closely together, it is likely that a lower productivity index would result and most of the interval between the packers for the section of lateral of interest would be left unfractured and less productive than planned. Controlling the initiation point as described herein can avoid this condition.

In support of the teachings herein, various analyses and/or analytical components may be used, including digital and/or analog systems. The system may have components such as a processor, storage media, memory, input, output, communications link (wired, wireless, pulsed mud, optical or other), user interfaces, software programs, signal processors (digital or analog) and other such components (such as resistors, capacitors, inductors and others) to provide for operation and analyses of the apparatus and methods disclosed herein in any of several manners well-appreciated in the art. It is considered that these teachings may be, but need not be, implemented in conjunction with a set of computer executable instructions stored on a computer readable medium, including memory (ROMs, RAMs), optical (CD-ROMs), or magnetic (disks, hard drives), or any other type that when executed causes a computer to implement the method of the present invention. These instructions may provide for equipment operation, control, data collection and analysis and other functions deemed relevant by a system designer, owner, user or other such personnel, in addition to the functions described in this disclosure.

One skilled in the art will recognize that the various components or technologies may provide certain necessary or beneficial functionality or features. Accordingly, these functions and features as may be needed in support of the appended claims and variations thereof, are recognized as being inherently included as a part of the teachings herein and a part of the invention disclosed.

While the invention has been described with reference to exemplary embodiments, it will be understood by those skilled in the art that various changes may be made and equivalents may be substituted for elements thereof without departing from the scope of the invention. In addition, many modifications will be appreciated by those skilled in the art to adapt a particular instrument, situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A method of fracturing an earth formation, comprising:

isolating a section of a borehole in the earth formation;

introducing a fluid into the isolated section;

increasing fluid pressure in the isolated section, and maintaining the isolated section at a substantially constant first pressure, the first pressure being of at least a magnitude sufficient to cause a fracture to form in the earth formation;

pressurizing the isolated section from the first pressure to a second pressure, the second pressure being a fracture pressure that is greater than the first pressure;

introducing a stress concentration to a borehole wall at at least one location in the isolated section when the fluid is at the second pressure or during the pressurization upon at least one of the fluid pressure reaching the second pressure and a selected flow rate or pressurization rate, wherein introducing the stress concentration to the borehole wall includes perforating the borehole wall at the at least one location; and initiating a hydraulic fracture in the earth formation at the at least one location.

2. The method of claim 1, wherein the first pressure is a mini-frac pressure.

3. The method of claim 2, wherein the first pressure is a leak-off pressure.

4. The method of claim 1, wherein the second pressure is at least sufficient to initiate the hydraulic fracture, and introducing the stress concentration includes perforating the borehole wall substantially concurrently with the fluid pressure reaching the second pressure.

5. The method of claim 1, wherein increasing the fluid pressure includes increasing the fluid pressure to at least the fracture pressure at a selected rate, and introducing the stress concentration includes perforating the borehole wall when the pressure increase is at the selected rate.

6. The method of claim 1, wherein the at least one location is at least one of an axial location along a longitudinal axis of the borehole and a circumferential location about the longitudinal axis.

7. The method of claim 1, wherein perforating the borehole wall include perforating the borehole wall at a plurality of locations arranged circumferentially about a longitudinal axis of the borehole.

8. The method of claim 1, wherein perforating the borehole well includes detonating a shaped charge.

9. The method of claim 1, wherein isolating includes actuating one or more packers.

10. An apparatus for fracturing an earth formation, comprising:

an isolation assembly configured to isolate a section of a borehole in the earth formation;

a fracturing assembly configured to be disposed at the isolated section, the fracturing assembly in fluid communication with a fluid source and including at least one passage to introduce fluid into the isolated section, the fracturing assembly configured to introduce a fluid into the isolated section and pressurize the isolated section to a substantially constant first pressure, the first pressure being of at least a magnitude sufficient to cause a fracture to form in the formation, and increase fluid pressure in the isolated section from the first pressure to a second pressure to initiate a hydraulic fracture in the earth formation; and at least one perforation device disposable at a selected location within the isolated section and configured to introduce a stress concentration to a borehole wall at at least one location in the isolated section when the fluid is at the selected pressure or during the increasing of the fluid pressure, in response to at least one of the fluid pressure reaching at least the fracture pressure and a selected flow rate or pressurization rate.

11. The apparatus of claim 10, wherein the at least one perforation device is configured to actuate in response to a trigger, and the trigger is selected from at least one of a pressure magnitude and a rate or pressure increase.

12. The apparatus of claim 10, wherein the at least one perforation device includes a plurality of perforation devices circumferentially arranged about a longitudinal axis of the borehole and directly substantially radially outwardly from the longitudinal axis.

13. The apparatus of claim 10, wherein the at least one perforation device includes at least one shaped explosive charge.

14. The apparatus of claim 10, further comprising at least one control unit configured to control at least one of the fracturing assembly and the at least one perforation device.

15. The apparatus of claim 14, wherein the control unit is configured to actuate the at least one perforation device substantially concurrently with the fluid pressure reaching at least the second pressure.

16. The apparatus of claim 14, wherein the control unit is configured to increase the fluid pressure to at least the second pressure, and actuate the at least one perforation device when the fluid pressure is at least the second pressure.

17. The apparatus of claim 14, wherein the control unit is configured to increase the fluid pressure to at least the second pressure at a selected rate, and actuate the at least one perforation device when the pressure increase is at the selected rate.

18. The apparatus of claim 10, wherein the isolation assembly includes at least one packer.

* * * * *